US010246847B2

(12) United States Patent
Wiedenmann et al.

(10) Patent No.: US 10,246,847 B2
(45) Date of Patent: Apr. 2, 2019

(54) CLEANING DEVICE FOR CLEANING AN UNDERWATER GROUND-WORKING APPARATUS AND METHOD

(71) Applicant: BAUER Spezialtiefbau GmbH, Schrobenhausen (DE)

(72) Inventors: Ulli Wiedenmann, Schrobenhausen (DE); Christoph Schroeppel, Harburg (DE); Diego Bellato, Schrobenhausen (DE)

(73) Assignee: BAUER Spezialtiefbau GmbH, Schrobenhausen (DE)

( * ) Notice: Subject to any disclaimer, the term of this patent is extended or adjusted under 35 U.S.C. 154(b) by 0 days.

(21) Appl. No.: 15/478,073

(22) Filed: Apr. 3, 2017

(65) Prior Publication Data

US 2017/0292240 A1 Oct. 12, 2017

(30) Foreign Application Priority Data

Apr. 8, 2016 (EP) ..... 16164496

(51) Int. Cl.

| | |
|---|---|
| ***E02D 23/06*** | (2006.01) |
| ***E02D 15/06*** | (2006.01) |
| ***E02F 3/90*** | (2006.01) |
| ***E02F 9/06*** | (2006.01) |
| ***B08B 3/02*** | (2006.01) |

(Continued)

(52) U.S. Cl.

CPC ..... *E02D 15/06* (2013.01); *B08B 3/02* (2013.01); *B08B 15/026* (2013.01); *E02F 3/90* (2013.01); *E02F 5/006* (2013.01); *E02F 9/06* (2013.01); *E02D 2250/0023* (2013.01);

(Continued)

(58) Field of Classification Search

CPC ..... E02D 15/06; E02D 23/06; B08B 15/02; E02F 5/006; E02F 9/06; B65D 25/04; B65D 25/06

USPC ..... 220/560, 531, 529, 501; 166/364; 299/9; 405/8, 11–13

See application file for complete search history.

(56) References Cited

U.S. PATENT DOCUMENTS 3,799,614 A * 3/1974 Miscovich ..... B65G 53/30 299/17
4,969,776 A * 11/1990 Bunce ..... E02L 317/021 405/197
2007/0163483 A1* 7/2007 Chelaru ..... E02L 317/00 114/258

FOREIGN PATENT DOCUMENTS

DE 26 09 457 A1 9/1977
DE 10 2008 056262 B4 11/2010

(Continued)

OTHER PUBLICATIONS https ://www.911metallurgist.com/water-jet-rock-drilling/.*

(Continued)

*Primary Examiner* — Sean D Andrish
(74) *Attorney, Agent, or Firm* — Studebaker & Brackett PC

(57) ABSTRACT

The invention relates to a method for ground-working at a bottom of a body of water and a cleaning device for cleaning an underwater ground-working apparatus. The cleaning device has an enclosing body which extends substantially from a bottom of a body of water to above the water surface and enclosing an inner space, along which the ground-working apparatus can be moved, and a separating device, through which in the enclosing body an upper portion of the inner space can be separated off to form a cleaning area, in (Continued)

which the ground-working apparatus can be received and soil and contamination cleaned from it.

11 Claims, 4 Drawing Sheets

(51) Int. Cl.

| | |
|---|---|
| ***B08B 15/02*** | (2006.01) |
| ***E02F 5/00*** | (2006.01) |
| *E02F 9/20* | (2006.01) |
| *E02F 9/22* | (2006.01) |

(52) U.S. Cl.
CPC ..... *E02D 2250/0076* (2013.01); *E02D 2300/0018* (2013.01); *E02F 9/2016* (2013.01); *E02F 9/2271* (2013.01)

(56) References Cited

FOREIGN PATENT DOCUMENTS

| | | | |
|---|---|---|---|
| EP | 2 998 037 A1 | | 3/2016 |
| JP | 58131230 | * | 8/1983 |
| JP | 62233335 | * | 10/1987 |
| JP | 2004011321 | * | 1/2004 |
| JP | 4938886 B1 | | 5/2012 |
| WO | 01/71106 A1 | | 9/2001 |

OTHER PUBLICATIONS

The extended European search report issued by the European Patent Office dated Oct. 5, 2016, which corresponds to EP16 164496.
Japan Platform for Patent Information (J-PlatPat) website, computer translation of the detailed description of JP 62-233335 to Ogawa. FIGS. 1-5 from the Japanese publication of Ogawa. Abstract.

* cited by examiner

CLEANING DEVICE FOR CLEANING AN UNDERWATER GROUND-WORKING APPARATUS AND METHOD

BACKGROUND OF THE INVENTION

The invention relates to a cleaning device for cleaning an underwater ground-working apparatus.

The invention further relates to a method for working at the bottom of a body of water, wherein an underwater ground-working apparatus is lowered from a floating work platform, the ground at the bottom of the body of water is worked with the ground-working apparatus and then the ground-working apparatus is brought back onto the work platform.

In certain cases it is necessary to carry out foundation works in particular for structures under water. Such works may be necessary for example when constructing bridges, dock installations or when founding wind power plants or tidal turbines. The body of water can be a river, lake or also a sea.

When creating an underwater foundation, ground is removed by means of an underwater ground-working apparatus, in order for example to create a bore for the foundation element. For environmental protection reasons it may be necessary to limit pollution of the water by ground material that has been removed and possibly also by added binders.

DE 10 2008 056262 B4 discloses a device and a method for foundation works under water, wherein a bell-like container is arranged around a drilling site at the bottom of the body of water. Drilling debris arising during drilling can be received in the inner space of the bell-like container and removed from there to the water surface by means of a pumping device. Already through this measure, the harm caused to the water when carrying out underwater foundation works can be considerably reduced.

In the case of works in particularly sensitive areas, for example in nature reserves, or in areas in which the bottom of the body of water is contaminated with harmful substances, a further reduction in environmental pollution is desirable.

BRIEF SUMMARY OF THE INVENTION

It is the object of the invention to indicate a device and a method, with which underwater foundations can be created in a particularly environmentally friendly way.

According to the invention a cleaning device for cleaning an underwater ground-working apparatus, is provided, having an enclosing body, which extends substantially from a bottom of a body of water to above a water surface and encloses an inner space, along which the ground-working apparatus can be moved, and having a separating device, by means of which, within the enclosing body, an upper portion of the inner space can be separated off to form a cleaning area, in which the ground-working apparatus can be received and cleaned with the removal of dirt, contamination etc.

The invention is based on the recognition that the pollution of the body of water is not only caused directly by ground material removed from the work site. A notable pollution of the body of water can be caused by the underwater ground-working apparatus itself when it is brought back from the bottom of the body of water after the ground-working has been carried out. The ground-working apparatus is usually soiled or polluted on its outer side by the ground work with ground material that has been removed and/or added binders. When bringing back through the body of water, this dirt or pollution may be rinsed off and therefore contaminate the surrounding water. This applies for example when work is carried out at the bottom of the water in the area of a dock, in which over a long period of time harmful substances have collected at the bottom of the body of water. Corresponding problems can arise also in particular in bodies of water with radioactive deposits or with undersea waste disposal sites.

According to the invention it is possible to avoid contaminating the body of water insofar as an enclosing body is provided, which extends from the work site at the bottom of the body of water to above the water surface. The tubular or box-like enclosing body prevents soiled or contaminated particles from flowing away from the ground-working apparatus and reaching the surrounding open body of water. Furthermore a separating device is provided according to the invention on the enclosing body, wherein an upper portion of the inner space of the enclosing body can be separated off to form a cleaning area. In this cleaning area the ground-working apparatus can be cleaned, thus any dirt or contamination stuck to it can be removed. The ground-working apparatus can be made available in such a cleaned state for further works at the bottom of the body of water without adherent dirt or contamination is brought into the body of water, when repeated lowering of the ground-working apparatus to the bottom of the body of water. The dirt and contamination removed during cleaning remain in the enclosing body and in particular in the separated cleaning area, from which the dirt and contamination can be removed relatively easily.

The enclosing body can in principle be a tubular body or a box-like element, by means of which an inner space can be enclosed. In a preferred embodiment of the invention the enclosing body has a telescopic portion, with which a length of the enclosing body can be changed. The enclosing body can therefore be adapted to different depths. The telescopic portion can be composed in particular of a plurality of ring-shaped elements which can be displaced inside each other in the manner of a telescope. It is not absolutely necessary for the enclosing body to be completely sealed with respect to the surrounding body of water. Instead it is provided in a preferred way that within the enclosing body the water level is the same as outside of the enclosing body in order to produce pressure equilibrium. For this, one or more openings are provided on the enclosing body. The individual elements of the enclosing body are, however, sealed to such an extent that no notable dirt or contamination from the inner space of the enclosing body can penetrate outwards into the surrounding body of water.

The enclosing body is placed in a particularly sealed way at the bottom of a body of water according to a refinement of the invention by a flexible placing area, on which the enclosing body can be placed, being provided at the bottom of the body of water. For this, in particular rubber elements or inflatable tube or hose elements can be provided. Other adjustable elements or those that can be adapted to the bottom of the body of water can also be arranged in the lower area of the enclosing body.

To remove dirt and contamination from the inner space of the enclosing body it is advantageous according to one variant that at least one pumping device is provided for pumping the water out of the inner space. A pumping device can preferably be provided in the area of the work site.

It is particularly preferred according to a refinement of the invention that at least one pumping device is arranged in the cleaning area. By means of this pumping device in the cleaning area, the dirt and contamination arising during cleaning can be directly pumped away from the inner space. The dirt and contamination can be received in tanks or filtered out through a corresponding wastewater treatment or otherwise separated off, so that the water can be recycled or used elsewhere at least as service water.

To separate the cleaning area from the rest of the inner space of the enclosing body, different elements can be provided. In one simple variant, one or more flexible separating plates, preferably made of a rubber or plastic material, can form a separating plane in an elastically adjustable manner. Through these elastic horizontal elements, the ground-working apparatus can then be moved to the bottom of the body of water and subsequently withdrawn again. During withdrawal the individual elastic separating elements return to their closed position so that the cleaning area is separated off from the lower inner space of the hollow body.

In a particularly advantageous embodiment of the invention the separating device has at least one pivotably mounted separating plate which can be pivoted between a side open position and a separating position, in which the separating flap blocks off the upper cleaning area from the lower inner space of the enclosing body. A plurality of separating flaps can preferably also be provided which are moved similarly to a hatch. The separating flap is preferably designed as an arc-shaped element.

In principle the at least one separating flap can be activated manually or via a motor preferably located outside of the body of water, for example by means of a cable winch mechanism. It is particularly useful according to one variant of the invention that the at least one separating flap can be adjusted by means of at least one actuating cylinder. The actuating cylinder is in particular a hydraulic cylinder which can move the separating flap also under water against relatively great resistances. The actuating cylinder is preferably arranged outside of the water, wherein the separating flap can be moved via corresponding actuating members or pull cables.

Cleaning the soiled or contaminated ground-working apparatus in the cleaning area can be brought about for example manually by corresponding operating staff, in particular by means of high pressure jets or pressure hoses. In a particularly useful embodiment of the invention a cleaning device is provided which is designed for cleaning ground material from an outer side of the ground-working apparatus. The cleaning device can have in particular one or a plurality of adjustable high pressure jets, with which soil or contamination that has become stuck to the ground-working apparatus can be removed from it by spraying water onto it. The cleaning device can have, additionally or alternatively, cleaning brushes or other cleaning elements, which automatically remove the soil and contamination from the outer side of the ground-working apparatus.

The invention further comprises an underwater ground-working apparatus for carrying out works at a bottom of a body of water, having a floating work platform and an underwater ground-working apparatus, which can be lowered from the floating work platform to the bottom of the body of water for ground works to be carried out. A cleaning device is arranged according to the invention on the floating work platform, as previously described.

The work platform can be in particular a vessel or a pontoon. The cleaning device is thereby releasably attached to one side of the floating work platform.

Particularly effective environmental protection is achieved according to one refinement of the invention by an installation for receiving and/or treating contaminated water being arranged on the work platform, wherein the contaminated water is fed from the inner space of the cleaning device. Pumped-away, contaminated water can be stored in the simplest embodiment in holding tanks. Soil or pollution can then settle at the bottom in the tanks. Alternatively, an active cleaning of the soiled or contaminated water is also possible, for example by means of filter devices or other devices for solid-liquid separation. In principle a chemical treatment can also be carried out alternatively or additionally on the floating work platform.

In a further preferred embodiment of the invention the ground-working apparatus is a trench wall cutter or a drilling unit. The drilling unit can be a continuous flight auger or preferably a drilling unit with a drilling bucket. The use of a trench cutter having preferably two pairs of cutting wheels is particularly advantageous. It is particularly advantageous if a feed device for supplying binder is provided on the trench wall cutter in the region of the cutting wheels. A mixed-in-place process can thus be carried out with the trench wall cutter, wherein the ground material cut away remains in the cutting slot and is mixed directly by the cutter with a binder, in particular cement or a cement solution, so that a solid foundation element is created from the binder and the ground material.

The method according to the invention is characterised in that a cleaning device is arranged, as has been previously described, and during retrieval of the ground-working apparatus soil and contamination are removed from it with the cleaning device. The advantages already described in the context of the cleaning device according to the invention thus result.

According to one refinement of the method according to the invention it is preferred that at least one foundation element is produced at the bottom of a body of water. The foundation element can be a foundation pile, a foundation diaphragm wall element, or a diaphragm wall in its entirety. The foundation element can be used for the foundation of a structure or to stabilise the ground generally.

Furthermore there is an advantageous method variant according to the invention, wherein, to form the at least one foundation element, a hole is produced by removing ground material, wherein the foundation element is formed in the hole by mixing a binder with at least a part of the ground material that has been removed. In such mixed-in-place processes, in spite of the creation of the foundation element, relatively limited ground material is removed from the ground. Indeed, the majority of the ground material, ideally all the ground material removed, remains in the ground and forms, with an added binder, the hardened foundation element. Such a method is also used as a CSM process (CSM is a registered trade mark).

BRIEF DESCRIPTION OF THE SEVERAL VIEWS OF THE DRAWINGS

The invention will be described in more detail below by reference to preferred exemplary embodiments, which are shown schematically in the drawings, in which.

DETAILED DESCRIPTION OF THE INVENTION

Figure 1:
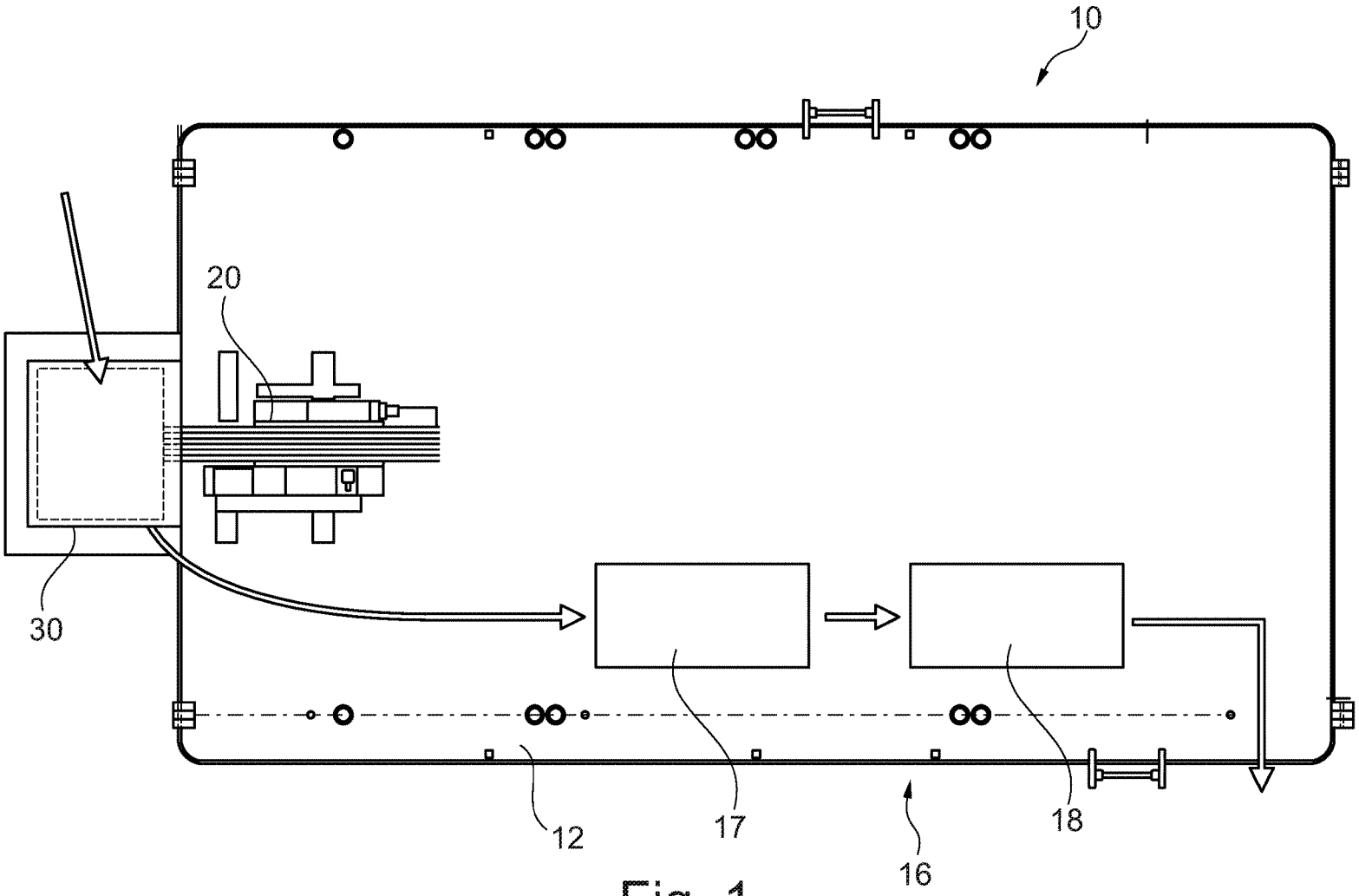
FIG. 1 shows a schematic top view of an underwater ground-working apparatus according to the invention.

An underwater ground-working apparatus 10 according to the invention according to FIG. 1 has a rectangular, pontoon-like, floatable work platform 12, on which a ground-working apparatus 20 is movably arranged. A box-like cleaning device 30 is attached so that it can be moved along a work area of the ground-working apparatus 20, the box-like cleaning device 30 extending from the work platform 12 to a bottom of a body of water. Soiled or contaminated water can be conveyed from the cleaning device 30, as schematically shown by arrows, to an installation 16 with a gathering tank 17. In the gathering tank 17, particle-form solids can settle at the bottom of this gathering tank 17. For further treatment and cleaning of the water, this water can be pumped from the gathering tank 17 to a treatment device 18. The treatment device 18 can be a filter system or another cleaning system for separating off solid particles and harmful substances from the water. In the exemplary embodiment shown, the cleaned water can be conveyed back into the body of water, on which the platform 12 floats.

Figure 2:
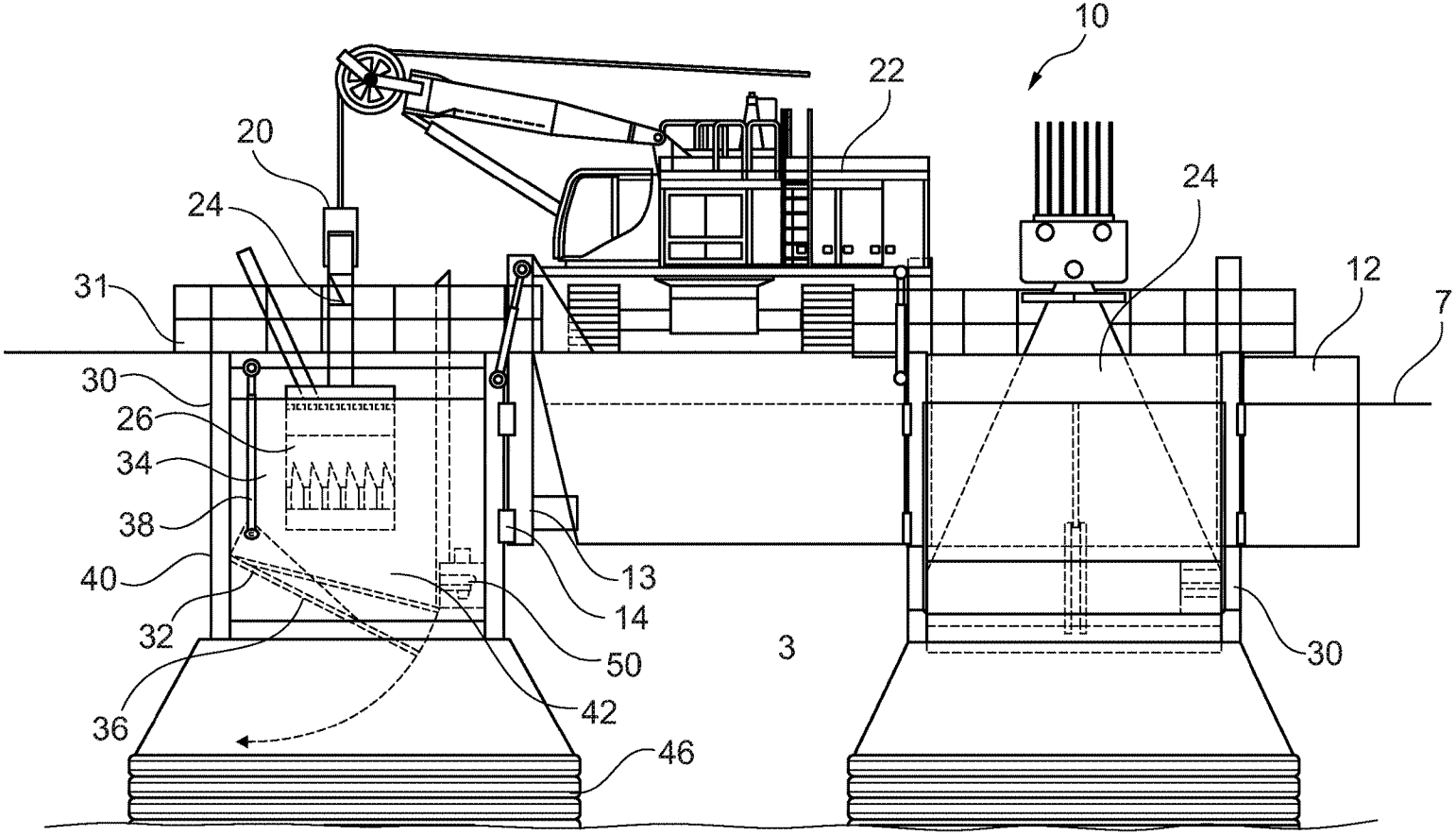
FIG. 2 shows a schematic partial side view of an underwater ground-working apparatus according to the invention.

According to FIG. 2 a further underwater ground-working apparatus 10 according to the invention is shown, having a work platform 12 floating on a body of water 3. A cleaning device 30 with a box-like enclosing body 40 is mounted on the side of the pontoon-like work platform 12 so that it can be vertically displaced along a guide 13 via sliding blocks 14. The box-like enclosing body 40 of the cleaning device 30 extends from an area above the water surface 7 to a bottom of the body of water 5. The enclosing body 40 encloses an inner space 34 and separates this in a substantially sealed manner from the surrounding body of water 3. In an upper area of the inner space 34 a cleaning area 42 is provided, which is separated from the lower area of the inner space 34 by means of a separating device 32 with a separating flap 36, which can be actuated by an actuating cylinder 38. The lower area of the enclosing body 40 widens conically as far as a placing-onto area 46, which is designed to be flexible, for example with a bellows, so that it can adapt to the surface of the bottom of the body of water 5.

An underwater ground-working apparatus 20 is arranged at the surface of the work platform 12, which is composed of a substantially conventional carrier unit 22 with crawler chassis and rotatable upper structure. By means of a support cable, a cutter 24 with two cutting wheel pairs 26 is arranged vertically movably as an actual ground removal tool.

To carry out works at the bottom of the body of water 5 within the enclosing body 40, the cutter 24 is lowered to the bottom of the body of water 5 and can cut into it. To form a foundation element, the cut away ground material can be mixed in situ with an added binder. The binder-ground mixture thus produced can set to form a foundation element. In the working position of the cutter 24 in the bottom of the body of water 5 the separating flap 36 is moved via the actuating cylinder 38 into an open position, so that the cutter 24 can be adjusted axially freely. After the cutter 26 has been brought back into the upper cleaning area 42 of the enclosing body 40, the separating flap 36 is moved by means of the actuating cylinder 38 into a substantially horizontal, slightly inclined closed position. In this closed position, the upper cleaning area 42 is separated in a substantially sealed way from the lower inner space 34 of the enclosing body 40. By means of cleaning nozzles, only shown schematically with an arrow, the outer side of the cutter 26 can be cleaned in the cleaning area 42 with the removal of dirt and contamination, in particular with the removal of binder and ground material sticking to it. The cleaning device can be in particular high pressure jets, which are preferably actuated automatically or manually. Soil and contamination that have been removed settle in the lower area of the cleaning area 42. At the deepest point a pumping device 50 is arranged, with which the deposited soil and contamination are conveyed away to the installation 16 on the work platform 12 for further treatment.

By means of the adjustable guide 13, the box-like cleaning device 30 can be moved along the outer side of the work platform 12, so that it can assume different work positions, as schematically indicated by the arrangement of a second cleaning device 30 in FIG. 2.

Figure 3:
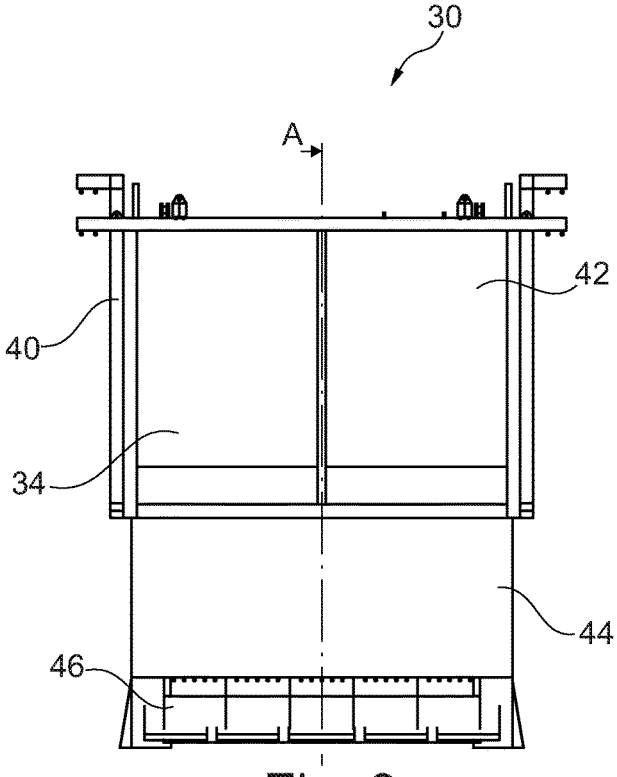
FIG. 3 shows a side view of a cleaning device according to the invention.
Figure 4:
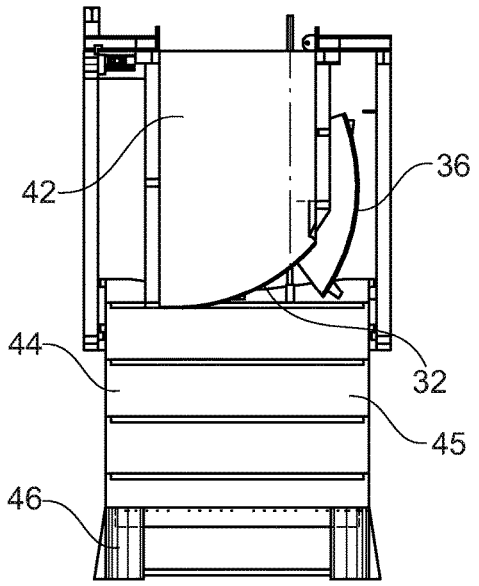
FIG. 4 shows a partially cut side view of the cleaning device of FIG. 3.
Figure 5:
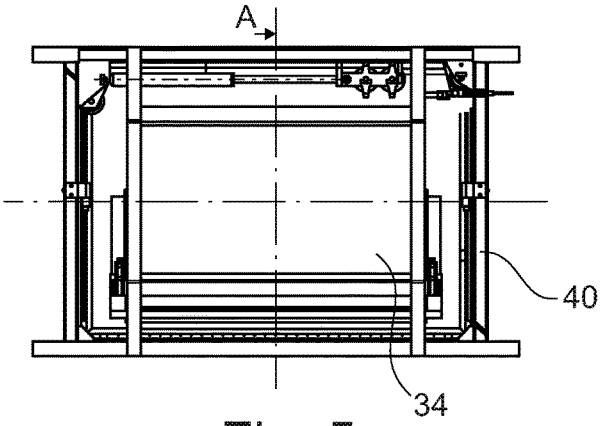
FIG. 5 shows a top view of the cleaning device of FIG. 3 and FIG. 4.

An exemplary embodiment of a cleaning device 30 according to the invention is shown in FIGS. 3 to 5. The cleaning device 30 comprises a box-like, rectangular enclosing body 40, which encloses a corresponding inner space 34. Besides a solid, upper area, which forms the cleaning area 42, the enclosing body 40 has a lower telescopic portion 44. The telescopic portion 44 is formed from a plurality of ring segments 45 which can be axially adjusted relative to each other in order to bring about a length adaptation to different depths. A lower side of the enclosing body 40 is formed by a flexible placing-onto area 46 made of rubber or plastic elements, which can adapt to a topography of the bottom of a body of water.

The upper cleaning area 42 can be separated from the lower inner space 34 by a separating device 32 with an arc-shaped separating flap 36. In the separated position, cleaning of the ground-working apparatus 20 can take place in the cleaning area 42, wherein detached dirt particles remain in the upper cleaning area 42 and can be removed from there.

Figure 6:
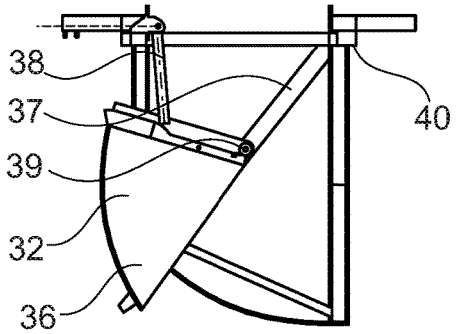
FIG. 6 shows a schematic side view of a separating device.
Figure 7:
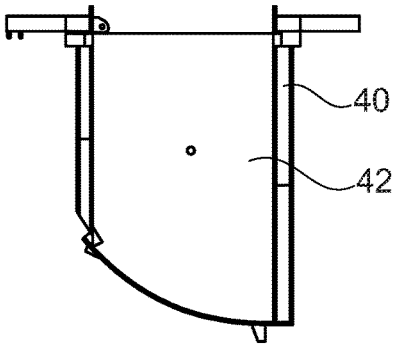
FIG. 7 shows a further schematic side view of a separating device.
Figure 8:
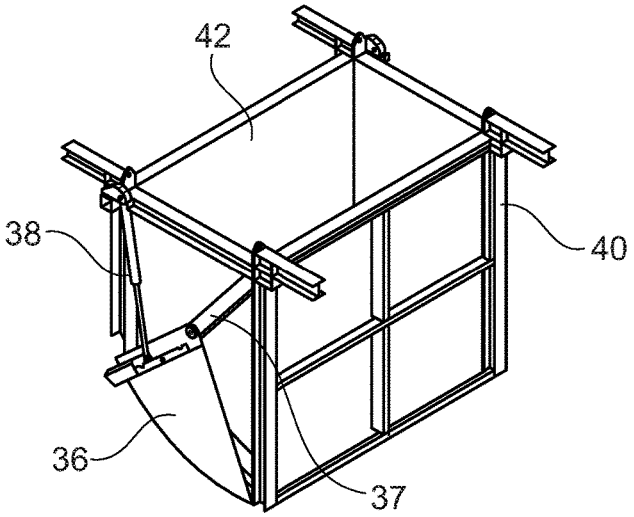
FIG. 8 shows a perspective view of the separating device of FIG. 6.

FIGS. 6 to 8 show a possible embodiment of a separating device 32 for separating the cleaning area 42 in the inner space 34. The separating device 32 has a blade-like separating flap 36, which is pivotably attached via a lever arm 37 to the enclosing body 40. The lever arm 37 is connected via a pivot joint 39 to an upper end of the separating flap 36.

FIG. 6 shows an open position of the separating flap 36, wherein a pivot cylinder 38 has been moved in. By moving out the pivot cylinder 38, the separating flap 36 is pivoted about the pivot joint 39 on the lever arm 37 into a closed position, which is shown in FIG. 8. A cleaning area 42 is thus separated off from the rest of the inner space 34 in the enclosing body 40.

The invention claimed is:

1. A cleaning device for cleaning an underwater ground-working apparatus, the cleaning device comprising:

an enclosing body which extends substantially from a bottom of a body of water to above a water surface and encloses an inner space, wherein the inner space is configured so that a trench cutter or a drilling unit is movable within the inner space, and a separating device, through which in the enclosing body an upper portion of the inner space is configured to be separated off to form a cleaning area, wherein the cleaning area is configured so that the trench cutter or the drilling unit is receivable within the cleaning area, and wherein the cleaning area is configured so that dirt is removable from the trench cutter or the drilling unit, wherein the enclosing body has a telescopic portion, with which a length of the enclosing body is configured to be changed, and wherein the separating device has at least one pivotably mounted separating flap, which is configured to be pivoted between a side open position and a separating position, in which the at least one pivotably mounted separating flap blocks off an upper cleaning area from a lower inner space of the enclosing body.

2. The cleaning device according to claim 1, wherein a flexible placing-onto area is provided for placing the enclosing body at the bottom of the body of water.

3. The cleaning device according to claim 1, wherein at least one pumping device is arranged for pumping water away from the inner space.

4. The cleaning device according to claim 3, wherein the at least one pumping device is arranged in the cleaning area.

5. The cleaning device according to claim 1, wherein the at least one pivotably mounted separating flap is configured to be adjusted by means of at least one actuating cylinder.

6. The cleaning device according to claim 1, wherein the cleaning device is provided, which is designed to clean ground material away from an outer side of the trench cutter or the drilling unit.

7. The underwater ground-working apparatus for carrying out works at the bottom of the body of water, the underwater ground-working apparatus comprising:

a floating work platform and the underwater trench cutter or the drilling unit which is configured to be lowered from the floating work platform to the bottom of the body of water for ground works, wherein the cleaning device according to claim 1 is arranged on the floating work platform.

8. The underwater ground-working apparatus according to claim 7, wherein an installation for receiving, receiving and treating, or treating contaminated water is arranged on the floating work platform, the water being fed from the inner space of the cleaning device.

9. A method for ground-working at the bottom of the body of water, the method comprising:

lowering the underwater trench cutter or the drilling unit from a floating work platform, working the ground at the bottom of the body of water with the trench cutter or the drilling unit, and subsequently bringing back the trench cutter or the drilling unit onto the floating work platform, wherein the cleaning device according to claim 1 is arranged, and upon being brought back from working the bottom of the body of water, cleaning the trench cutter or the drilling unit with the cleaning device with removal of soil and contamination.

10. The method according to claim 9, comprising:

producing at least one foundation element at the bottom of the body of water.

11. The method according to claim 10, comprising:

producing a hole to form the at least one foundation element by removal of ground material, wherein the at least one foundation element is formed in the hole by mixing a binder with at least a part of the ground material removed.

* * * * *